US006559366B1

(12) United States Patent
Takahashi

(10) Patent No.: US 6,559,366 B1
(45) Date of Patent: May 6, 2003

(54) FIXING STRUCTURE OF SCREWS FOR ADJUSTMENT ON AIRTIGHT CLOSING OF TONE HOLES OF WOODWIND INSTRUMENTS

(75) Inventor: Kazuhiro Takahashi, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/758,808

(22) Filed: Jan. 11, 2001

(30) Foreign Application Priority Data

Jan. 14, 2000 (JP) ..... 2000-005534

(51) Int. Cl.[7] ..... G10D 7/00
(52) U.S. Cl. ..... 84/380 R; 84/385 A; 84/380 R
(58) Field of Search ..... 84/380 R, 381, 84/383 R, 383 A, 385 A

(56) References Cited

U.S. PATENT DOCUMENTS

| | | | | |
|---|---|---|---|---|
| 2,036,492 A | | 7/1936 | Pedler | |
| 3,286,577 A | | 11/1966 | Weidner, Jr. | |
| 3,805,665 A | * | 4/1974 | Oouchi | 84/380 C |
| 4,798,122 A | * | 1/1989 | Gisler et al. | 264/242 |

FOREIGN PATENT DOCUMENTS

| | | |
|---|---|---|
| DE | 919 751 | 11/1954 |
| DE | 72 33 829 | 11/1975 |
| EP | 0-047 061 | 7/1981 |
| JP | 7-310725 | 11/1995 |

OTHER PUBLICATIONS

German Office Action (w/ English summary).

* cited by examiner

*Primary Examiner*—Kim Lockett
(74) *Attorney, Agent, or Firm*—Dickstein, Shapiro, Morin & Oshinsky, LLP.

(57) ABSTRACT

A fixing structure is provided for fixing an adjustment screw for use in adjustment of closing of a tone hole of a tube body of a woodwind instrument by a key system. The adjustment screw is fixed to a screw fixing member such as a communicating plate or a stopper having a tapped hole. A block that is made by synthetic resin material is formed in a prescribed shape having a prepared hole penetrating therethrough and is detachably attached to the screw fixing member. For example, the block is placed in an engagement channel of the stopper, then, the adjustment screw having an external thread is screwed into the prepared hole of the block to be tapped by force and is further rotated to engage with the tapped hole of the stopper. To prevent the block from being easily extracted from the engagement channel of the stopper, both of the block and engagement channel are formed in substantially a trapezoidal shape in cross section. To prevent the adjustment screw from being easily loosened, an appropriate amount of rotation resistance between the adjustment screw and the prepared hole of the block is defined by setting prescribed dimensions such that a hole diameter of the prepared hole is set in proportion to an outer diameter d of the adjustment screw within a range between 0.85d and 0.95d.

8 Claims, 4 Drawing Sheets

FIXING STRUCTURE OF SCREWS FOR ADJUSTMENT ON AIRTIGHT CLOSING OF TONE HOLES OF WOODWIND INSTRUMENTS

BACKGROUND OF THE INVENTION

1. Field of the Invention

This invention relates to fixing structures for fixing screws that are used for adjustment on airtight closing of tone holes of tube bodies of woodwind instruments by key systems.

2. Description of the Related Art

In general, woodwind instruments such as flutes, oboes and clarinets have tube bodies whose tone holes are controlled to be opened or closed by key systems being operated by players. That is, players operate the key systems to selectively open or close the tone holes by shifting tampons in position, thus producing sounds having desired pitches. Due to leakage of air from the tone holes of the tube bodies, the woodwind instruments are varied in pitch, tone volume and tone color to cause deterioration of sound quality. In other words, if air leak from the tone holes of the tube bodies unintentionally against player's operations of the woodwind instruments, unwanted variations are caused to occur in pitch, tone volume and tone color of sound being produced. In that case, the players have difficulties in handling the woodwind instruments to stabilize production of sound in a good quality, so it becomes difficult for the players to produce beautiful woodwind sounds having desired pitches. It is needless to say that mechanical performance of the woodwind instruments is greatly and directly influenced by materials of tampons and construction of the tampons being incorporated into key cups as well as positional adjustments of the tempons on the tone holes. Herein, the tampons are brought into tight contact with the tone holes to prevent noise from being produced and to close the tone holes in an airtight manner. To achieve preferable performance of the key system of the woodwind instrument, the tampons are made using prescribed base materials which are made by placing felts of high quality and pasteboards in layers, wherein the felts are subjected to compressed formation in prescribed thickness, which approximately ranges between 2 mm and 3 mm, for example. Concretely speaking, the tampons are made by coating the base materials with coating materials such as skins (e.g., sheep or calf leathers) and bladders (e.g., sheep or goat internal skins).

The key system for operating the tampons is mainly constructed by key pipes, key cup arms, key cups and adjustment screws. Herein, the key pipes are pivotally supported by shafts to freely rotate, and the key cup arms are fixed to the key pipes. The key cups are attached to tip end portions of the key cup arms to store the tampons therein. The adjustment screws restrict rotation of the key cup arms to adjust closing degrees of the tampons on the tone holes. In general, there are provided two types of the key systems, namely, a close key system and an open key system. The close key system normally closes the tone holes in a non-performance mode, so it selectively opens the tone holes upon manual operations made by the player. The open key system normally opens the tone holes in a non-performance mode, so it selectively closes the tone holes upon manual operations made by the player.

With reference to FIGS. 4A and 4B, a description will be given with respect to a conventional example of a fixing structure of an adjustment screw, which is applied to an open key system that normally opens tone holes of a tube body of a woodwind instrument. Namely, a reference numeral 1 designates a tube body, 2 designates a tone hole which is formed at a selected position on an exterior periphery of the tube body 1, 3 designates a shaft that is arranged outside of the exterior periphery of the tube body 1 and is also arranged approximately in parallel with an axial line of the tube body 1, 4 designates a key pipe whose internal hole engages with the shaft 3 in a free rotation manner, and 5 designates a key cup arm that is fixed to a selected position of the key pipe 4 by braze, wherein a key cup (or simply a cup) 7 is installed on a tip end portion of the key cup arm 5. In addition, a reference numeral 6 designates a tampon (or pad) that is stored in the key cup 7 and is moved to open or close the tone hole 2, and 8 designates a communicating plate that is fixed to a selected position of the shaft 3 in connection with the key cup arm 5, wherein the communicating plate 8 has a tapped hole 8*a* with which an adjustment screw 9 is to be engaged. The key cup arm 5 has a communicating bearing 10 to project downwardly toward a tip end of the adjustment screw 9. When the key cup arm 5 is rotated to close the tone hole 2 by the tampon 6, the adjustment screw 9 comes in contact with the communicating bearing 10 to restrict further rotation of the key cup arm 5. If the tampon 6 imperfectly closes the tone hole 2 with a relatively low degree of closing, air is to be leaked from the tube body 1 by way of the tone hole 2 so that sound is deteriorated in quality or varied in pitch. To make adjustment on the woodwind instrument, a human operator (or worker) rotates the adjustment screw 9 to slightly change a contact timing at which the communicating bearing 10 comes in contact with the adjustment screw 9. Thus, the woodwind instrument is adjusted such that the tampon 6 closes the tone hole 2 in an optimal condition of closing.

With reference to FIGS. 5A and 5B, a description will be given with respect to another example of the fixing structure of the adjustment screw, which is applied to a close key system that normally closes tone holes, wherein parts identical to those of FIGS. 4A and 4B are designated by the same reference numerals. In FIGS. 5A and 5B, a stopper 11 is fixed to a selected position of a key pipe 4 in connection with a communicating plate 8. Herein, the stopper 11 has a tapped hole 11 a with which an adjustment screw 9 is to be engaged. When a tampon closes a tone hole, a tip end of the adjustment screw 9 is pressed against the communicating plate 8 by elastic force being produced by a spring (not shown). In such a close key system, a human operator rotates the adjustment screw 9 to change an angle of the stopper 11 against the communicating plate 8. Thus, a woodwind instrument installing the close key system is adjusted such that the tampon closes the tone hole in an optimal condition of closing by adjustment of the angle of the stopper 11 against the communicating plate 8.

The conventional fixing structures of adjustment screws of the woodwind instruments bear drawbacks in that the adjustment screws are loosened or released during musical performance of the woodwind instruments. So, engineers or human operators conventionally take various measures for prevention of loosening of the adjustment screws, as follows:

(1) An end of the communicating plate 8 is partially slit to form a forked portion whose slit communicates with the tapped hole 8*a* with which the adjustment screw 9 is engaged. After the adjustment screw 9 is completely screwed into the tapped hole 8*a*, the forked portion of the communicating plate 8 is caulked so that an interior circumference of the tapped hole 8*a* is intensely pressed against the adjustment screw 9. Thus, frictional force (or rotation resistance) is increased between the tapped hole 8a and adjustment screw 9. The aforementioned stopper 11 is also modified as similar to the communicating plate 8.

(2) Melted synthetic resin material is applied onto the adjustment screw 9 and is then solidified to provide appropriate rotation resistance between the tapped hole 8*a* and adjustment screw 9.

(3) The adjustment screw 9 is excessively screwed into the tapped hole 8*a* by force to cause partial destruction of screw thread.

The aforementioned measures are conventionally adopted for the woodwind instruments, however, there is a room for further improvements for prevention of loosening of the adjustment screws during musical performance of the woodwind instrument. In the above, a first measure (1) teaches that a forked portion is formed by slitting an end portion of the communicating plate 8 and is caulked to increase rotation resistance between the tapped hole 8*a* and adjustment screw 9 so that the adjustment screw 9 will be prevented from being loosened. In such a first measure, however, if a human operator strongly caulks the forked portion of the communicating plate 8 too much, it becomes impossible to further rotate the adjustment screw 9 within the tapped hole 8*a*. In contrast, if the human operator weakly caulks the forked portion, it is impossible to apply sufficient rotation resistance between the tapped hole 8*a* and adjustment screw 9 so that the adjustment screw 9 is to be easily loosened. That is, the first measure bears a difficulty to set optimal rotation resistance between them. Due to caulking, the tapped hole 8*a* is elastically deformed in an elliptical shape, which may cause an error of coordination between the tapped hole 8*a* and adjustment screw 9. That is, as long as their axes match with each other or cross with each other at a right angle, the adjustment screw 9 well engages with the tapped hole 8*a*. Otherwise, the adjustment screw 9 is easily rotated and loosened from the tapped hole 8*a*. A second measure (2) teaches that the synthetic resin material is applied onto the adjustment screw 9 and is solidified to prevent the adjustment screw 9 from being loosened from the tapped hole 8*a*. Such a second measure merely provides temporary fixture because if the human operator repeats adjustment by repeatedly rotating the adjustment screw 9, the solidified synthetic resin material is partially peeled off and dropped to reduce an effect of prevention of loosening of the adjustment screw 9. In addition, it is difficult to apply an appropriate amount of the synthetic resin material onto the adjustment screw 9. Further, the human operator is required to have a good skill in application of the synthetic resin material onto the adjustment screw. A third measure (3) teaches that the adjustment screw 9 is prevented from being loosened from the tapped hole 8*a* by partial destruction of screw thread. However, the third measure bears a difficulty to produce appropriate rotation resistance between the tapped hole 8*a* and adjustment screw 9. If the human operator repeats adjustment by repeatedly trying the third measure, the key system bears a reduction of the effect of prevention of loosening of the adjustment screw as similar to the second measure.

SUMMARY OF THE INVENTION

It is an object of the invention to provide a fixing structure of screws for adjustment on airtight closing of tone holes of tube bodies of woodwind instruments by adopting a simple structure for certainly preventing adjustment screws from being loosened from tapped holes in key systems.

This invention provides a fixing structure that fixes an adjustment screw for use in adjustment of closing of a tone hole of a tube body of a woodwind instrument by a key system. The adjustment screw is fixed to a screw fixing member such as a communicating plate or a stopper having a tapped hole. A block that is made by synthetic resin material is formed in a prescribed shape having a prepared hole penetrating therethrough and is detachably attached to the screw fixing member. For example, the block is placed in an engagement channel of the stopper, then, the adjustment screw having an external thread is screwed into the prepared hole of the block to be tapped by force and is further rotated to engage with the tapped hole of the stopper. Herein, a tip end of the adjustment screw projects outside of the tapped hole of the stopper and comes in contact with the communicating plate. To prevent the block from being easily extracted or dropped from the engagement channel of the stopper, both of the block and engagement channel are formed in a trapezoidal shape in cross section. To prevent the adjustment screw from being easily loosened from the block, it is necessary to provide an appropriate amount of rotation resistance between the adjustment screw and the prepared hole of the block. For this reason, a hole diameter of the prepared hole of the block is set in proportion to an outer diameter d of the adjustment screw within a range between 0.85d and 0.95d.

If the rotation resistance is reduced due to aged deterioration or abrasion, the fixing structure can be easily repaired by merely changing the block with new one, wherein it is unnecessary to change the adjustment screw with new one because the adjustment screw is made by metal material such as stainless steel having sufficient hardness and durability.

According to this invention, it is possible to certainly prevent the adjustment screw from being easily loosened with a simple construction, and it is possible to secure maintenance for maintaining desired mechanical performance of the key system by merely changing the block with new one.

BRIEF DESCRIPTION OF THE DRAWINGS

These and other objects, aspects and embodiment of the present invention will be described in more detail with reference to the following drawing figures, of which.

DESCRIPTION OF THE PREFERRED EMBODIMENT

This invention will be described in further detail by way of examples with reference to the accompanying drawings.

Figure 1:
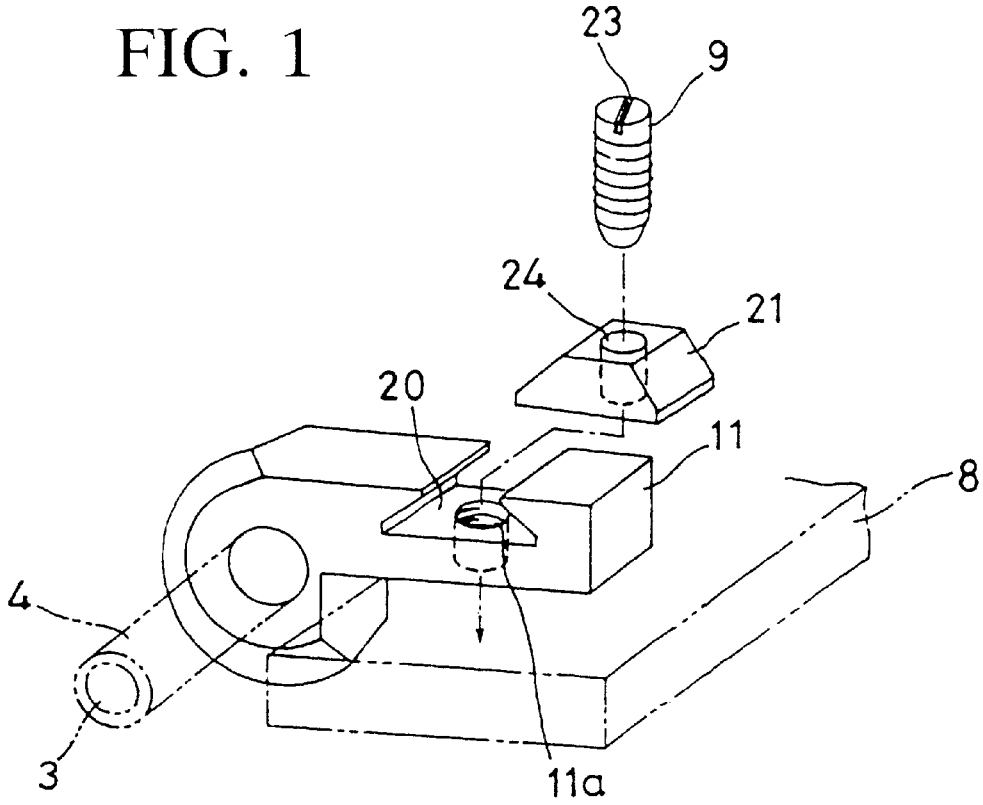
FIG. 1 is an exploded perspective view showing a fixing structure of an adjustment screw for use in adjustment of closing of a tone hole of a tube body by a close key system of a woodwind instrument in accordance with a preferred embodiment of the invention.
Figure 2:
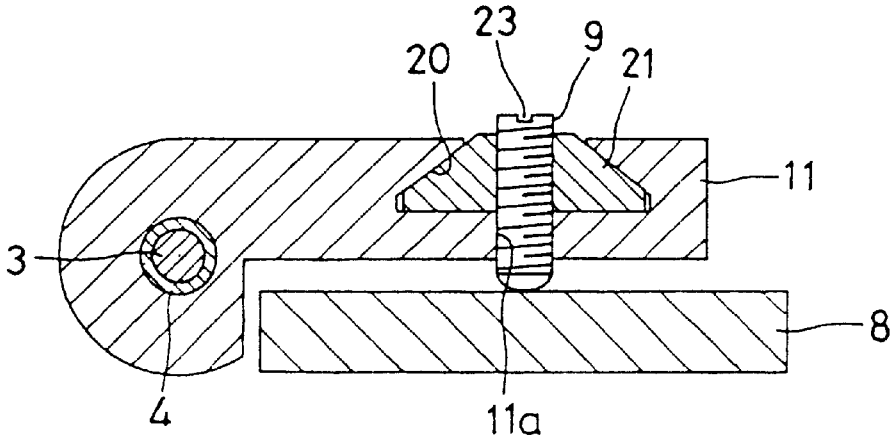
FIG. 2 is a cross sectional view showing the fixing structure of the adjustment screw in the close key system of the woodwind instrument.
Figure 3:
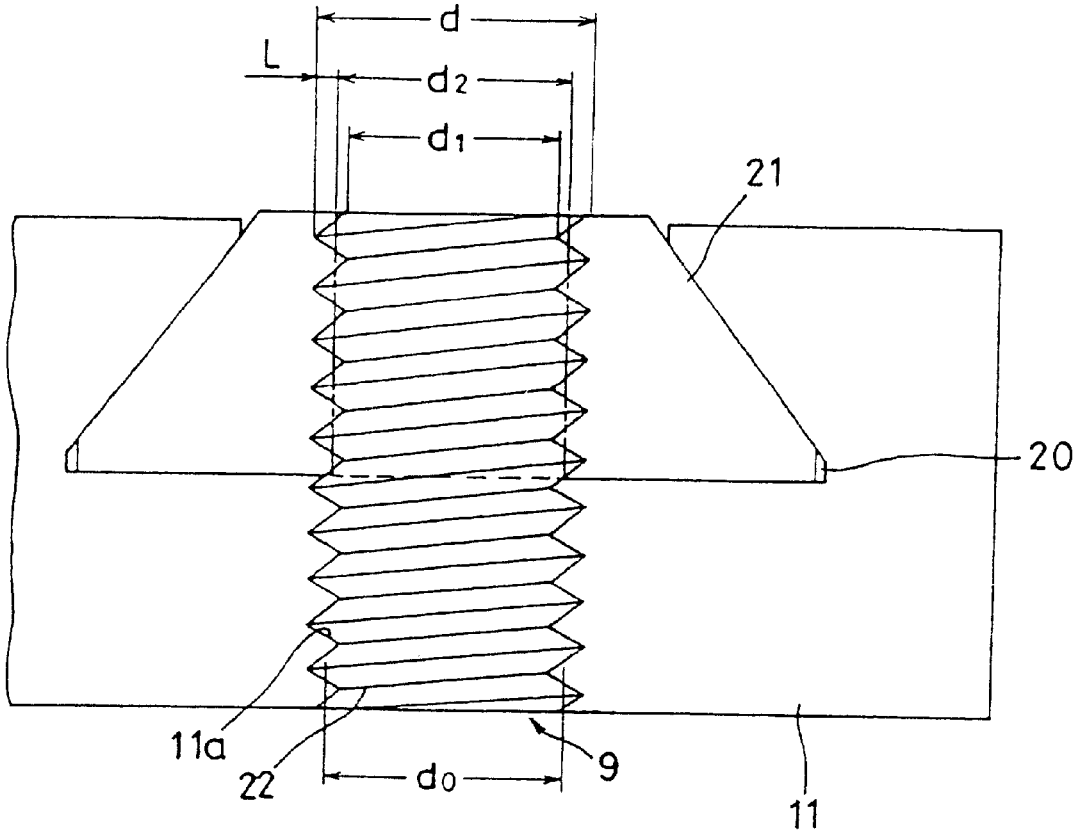
FIG. 3 is a schematic illustration showing the adjustment screw being engaged with a prepared hole and a tapped hole respectively.

FIG. 1 is an exploded perspective view showing a fixing structure of an adjustment screw for use in adjustment of closing of a tone hole of a tube body of a woodwind instrument in accordance with a preferred embodiment of the invention. FIG. 2 is a cross sectional view of the fixing structure of the adjustment screw, and FIG. 3 diagrammatically shows the adjustment screw engaged with a prepared hole and a tapped hole respectively. The present embodiment is designed as an example of application to a close key system of a flute in which each tone hole is normally closed by a tampon. In FIGS. 1, 2 and 3, parts identical to those shown in FIGS. 4A, 4B, 5A and 5B are designated by the same reference numerals, hence, the description thereof will be omitted to avoid repetition of explanation.

A communicating plate 8 is fixed to a shaft 3, which is attached to an exterior periphery of a tube body of the woodwind instrument (i.e., flute), by braze or solder. In addition, an internal hole of a key pipe 4 engages with the shaft 3 in a free rotation manner. Further, a stopper 11 (namely, a screw fixing member) is fixed to the key pipe 4 and is placed opposite to the communicating plate 8. An engagement channel 20 roughly having a trapezoidal shape in cross section is formed in the stopper 11 in connection with an upper surface of the stopper 11 whose lower surface is placed to face with the communicating plate 8. Herein, the engagement channel 20 is elongated by an overall width of the stopper 11. A tapped hole 11 a with which an adjustment screw 9 engages is formed to vertically penetrate through the stopper 11 at a center position of a bottom surface of the engagement channel 20. There is provided a block 21 roughly having a trapezoidal shape in cross section to suit to the "trapezoidal" engagement channel 20. That is, the block 21 is detachably attached to and engaged with the engagement channel 20 of the stopper 11 from its side directions. So, the block 21 engages with the engagement channel 20 and is fixed to the stopper 11 by the adjustment screw 9. The sectional shape of the engagement channel 20 is not necessarily limited to the trapezoidal shape, hence, the engagement channel 20 can be formed in any other shapes that prevent the block 21 from being easily extracted therefrom in an upward direction. The stopper 11 is made by prescribed metal material such as silver and nickel silver. The present embodiment is designed such that the block 21 is not easily extracted from the engagement channel 20 in an upward direction. Of course, it is possible to modify the present embodiment such that the block is not easily extracted or dropped from the engagement channel 20 in a downward direction.

The adjustment screw 9 is made by stainless steel to form an external thread or metric thread on an exterior periphery thereof The adjustment screw 9 as a whole is formed in a length of approximately 4.00 mm. In addition, the external thread of the adjustment screw 9 is defined by prescribed dimensions (see FIG. 3), namely, an outer diameter d of 2 mm ϕ, a minor diameter d1 of 1.567 mm ϕ, an effective diameter d0 of 1.740 mm ϕ and a pitch P of 0.4. The adjustment screw 9 penetrates through the block 21 and the tapped hole 11*a* of the stopper 11*a* respectively, so that a tip end of the adjustment screw 9 projects downwardly from the tapped hole 11*a* and comes into contact with an upper surface of the communicating plate 8. Herein, the tip end of the adjustment screw 9 is formed like a spherical face. In addition, a slot 23 (i.e., a non-cross channel) is formed on a head portion of the adjustment screw 9.

The block 21 is made by prescribed synthetic resin material such as nylon (e.g., 6-nylon or 6-6 nylon) and "Duracon" (which is a registered trademark of Polyplastics Co., Ltd.), wherein a prepared hole 24 is formed to vertically penetrate through the block 21 at its center position. That is, a human operator screws the adjustment screw 9 into the prepared hole 24 of the block 21, which engages with the engagement channel 20 of the stopper 11. A part of the external thread of the adjustment screw 9 passes through the prepared hole 24 of the block 21 and then engages with the tapped hole 11*a* of the stopper 11. Thus, the block 21 is fixedly connected with the engagement channel 20 of the stopper 11 by the adjustment screw When the human operator screws the adjustment screw 9 into the prepared hole 24 of the block 21, it is possible to produce appropriate rotation resistance between the adjustment screw 9 and the block 21. Due to the rotation resistance, it is possible to prevent the adjustment screw 9 from being easily loosened from the block 21. When the human operator presses and screws the adjustment screw 9 into the prepared hole 24 of the block 21, an external thread 22 (see FIG. 3) of the adjustment screw 9 is inserted into the prepared hole 24 to be tapped while forming an internal thread on an interior peripheral of the prepared hole 24, which is called "self tap". Due to the self tap, crests of thread ridges of the external thread 22 of the adjustment screw 9 are placed in tight contact with thread grooves of the internal thread being tapped on the interior periphery of the prepared hole 24 substantially without gaps, which avoid occurrence of "backlash" between the external thread of the adjustment screw 9 and the internal thread of the prepared hole 24. Hence, as compared with a "prepared" tapped hole which is prepared in advance for engagement with the adjustment screw, it is possible to produce a relatively large amount of rotation resistance between the adjustment screw 9 and the prepared hole 24 whose internal thread is not prepared in advance. Therefore, even if a relatively small amount of rotation resistance is provided between the adjustment screw 9 and the tapped hole 11*a* of the stopper 11, the adjustment screw 9 is not easily loosened from the "compulsorily tapped" internal thread of the prepared hole 24.

Because the block 21 is made by the synthetic resin material whose hardness is not so high, a human operator is capable of screwing the adjustment screw 9 into the prepared hole 24 by force with a prescribed tool such as a driver being manipulated by his/her normal manual power.

If the human operator repeatedly rotates the adjustment screw 9 multiple times, the internal thread of the prepared hole 24 of the block 21 is worn down to reduce rotation resistance, which will cause loosening of the adjustment screw 9 in the prepared hole 24 of the block 21. In that case, such a "worn down" block 21 is extracted from the stopper 11 and is replaced with new one. In contrast to the block 21 made by the synthetic resin material, the adjustment screw 9 is made by metal material, hence, there is substantially no possibility in that the adjustment screw 9 is easily deformed or its external thread is partially destructed or abraded. In addition, the prepared hole 24 of the block 21 does not necessarily raise a problem as to whether the adjustment screw 9 is new one or not. So, there is substantially no need to replace the adjustment screw with new one.

The rotation resistance being applied between the adjustment screw 9 and block 21 increases or decreases in proportion to a total amount of contact areas being formed between the external thread 22 of the adjustment screw 9 and the "compulsorily tapped" internal thread of the prepared hole 24 of the block 21. Hence, the rotation resistance can be set to an optimal value by adequately setting a hole diameter d2 of the prepared hole 24 and a contact length L corresponding to a tapped depth by which a thread ridge of the external thread 22 of the adjustment screw 9 digs into the interior wall of the prepared hole 24 of the block 21 so that the external thread 22 of the adjustment screw 9 comes in tight contact with the internal thread of the block 21. Concretely speaking, an optimal value of the rotation resistance can be obtained under a condition where the hole diameter d2 of the prepared hole 24 approximately ranges between 0.85d and 0.95d where d denotes the outer diameter of the adjustment screw 9. If the hole diameter d2 of the prepared hole 24 is under 0.85d, a relatively large amount of manual power is required to screw the adjustment screw 9 into the prepared hole 24 to be tapped by force. If the hole diameter d2 of the prepared hole 24 is above 0.95d, it may be easy for the human operator to screw the adjustment screw 9 into the prepared hole 24, however, rotation resistance between the adjustment screw 9 and prepared hole 24 becomes small. Therefore, it is not preferable that the hole diameter d2 of the prepared hole 24 becomes greater than or smaller than the prescribed range of 0.85d–0.95d. More specifically, it can be said that the hole diameter d2 of the prepared hole 24 should be defined to a range between 0.875d and 0.925d. To meet such a range, if d=2 mm, d2 belongs to a range of 1.75–1.85 mm.

Figure 4A:
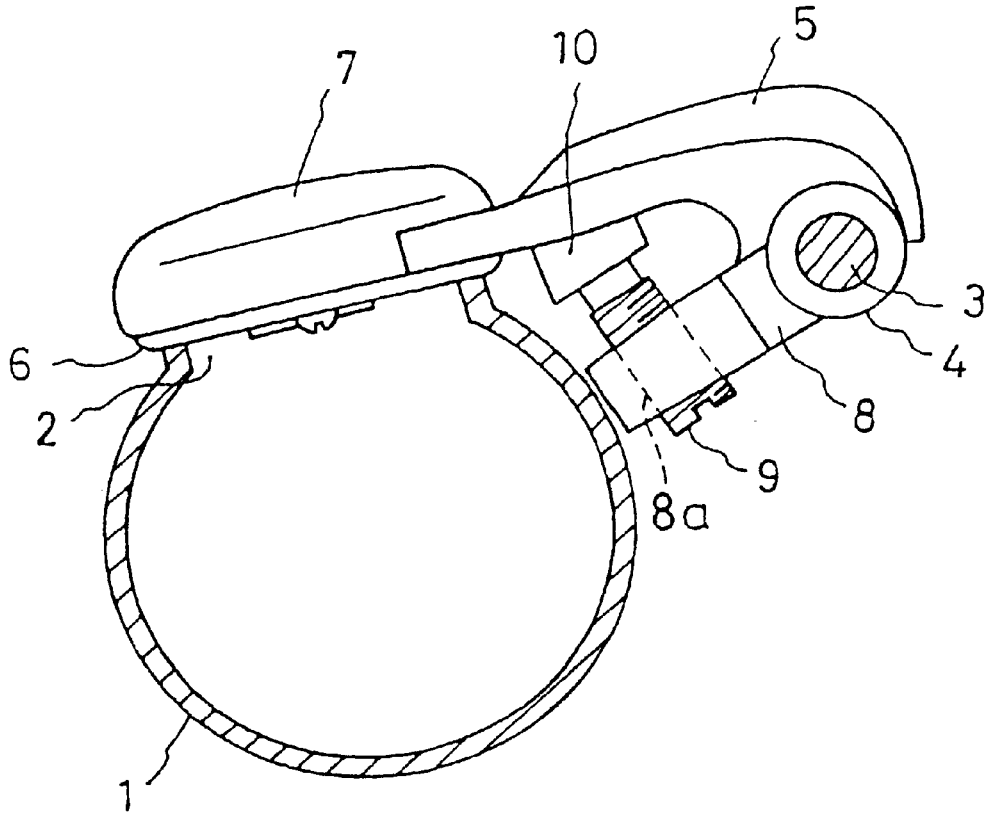
FIG. 4A is an enlarged view partly in section showing selected parts of an open key system that is conventionally applied to a woodwind instrument and that fixes an adjustment screw for adjustment on closing of a tone hole by a tampon.
Figure 4B:
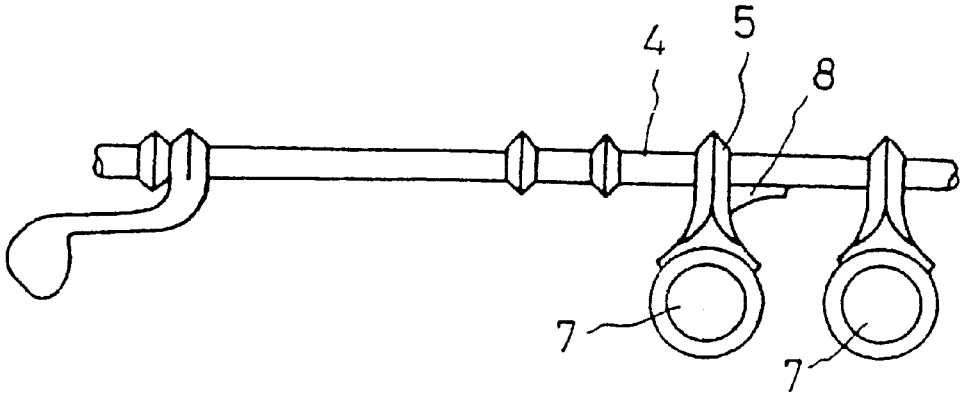
FIG. 4B is a plan view showing some parts of the open key system shown in FIG. 4A.
Figure 5A:
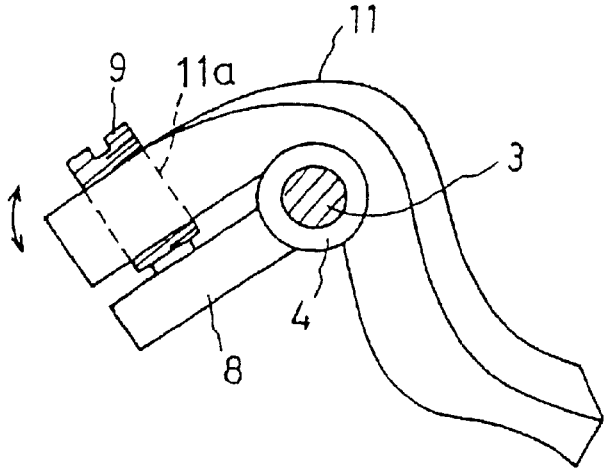
FIG. 5A is an enlarged view partly in section showing selected parts of a close key system that is conventionally applied to a woodwind instrument and that fixes an adjustment screw for adjustment on closing of a tone hole by a tampon.
Figure 5B:
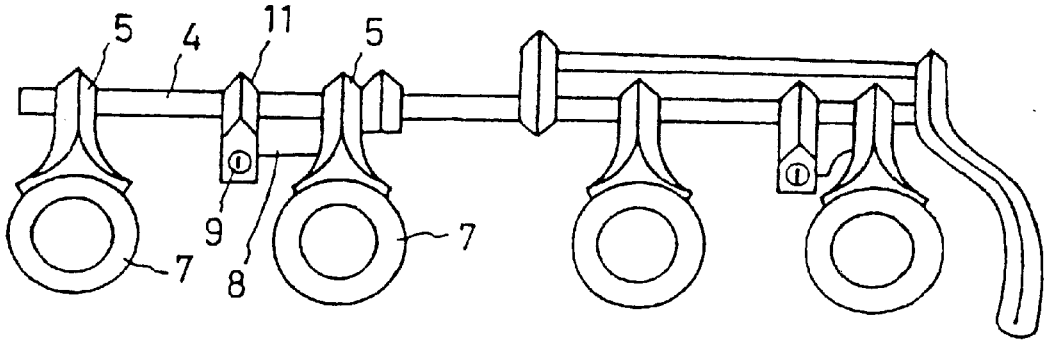
FIG. 5B is a plan view showing some parts of the close key system shown in FIG. 5A.

The present embodiment describes a fixing structure of an adjustment screw, which is applied to the close key system of the woodwind instrument whose tone holes are normally closed. Hence, the stopper 11 constructs a screw fixing member for use in fixture of the adjustment screw 9, wherein the block 21 is detachably attached to the stopper 11. If the aforementioned fixing structure is applied to the open key system of the woodwind instrument whose tone holes are normally opened as shown in FIGS. 4A and 4B, the communicating plate 8 constructs a screw fixing member for use in fixture of the adjustment screw 9. So, the present embodiment is modified such that the block 21 is detachably attached to the communicating plate 8.

Incidentally, it is possible to modify the present embodiment such that the stopper 11 and block 21 act as "double nuts". In this case, the block 21 is built into the engagement channel 20 of the stopper 11 such that the block 21 is capable of freely rotating and is also capable of slightly moving in a vertical direction within small elevation. The adjustment screw 9 is screwed into the prepared hole 24 of the block 21 to be tapped by force, then, it is further rotated and moved downwardly to engage with the tapped hole 22 of the stopper 11. Thereafter, the block 21 is rotated to press a bottom thereof against a bottom surface of the engagement channel 20 of the stopper 11.

As described heretofore, this invention has a variety of effects and technical features, which will be described below.

(1) This invention provides improvements in mechanical construction of the key system of the woodwind instrument in which adjustment screws are used for adjustment of closing degrees of tampons on tone holes. Specifically, this invention provides a brand-new fixing structure of an adjustment screw that is fixed to a screw fixing member (e.g., 8 or 11), wherein the adjustment screw is screwed into a prepared hole (24) of a block (21), which is made by synthetic resin material and is detachably attached to the screw fixing member, by force and is further rotated to engage with a taped hole (11*a*) of the screw fixing member.

(2) Due to the self tap, the prepared hole of the block is tapped to form an internal thread, which well engages with an external thread of the adjustment screw. Thus, it is possible to apply an appropriate amount of rotation resistance between the adjustment screw and the prepared hole of the block, which certainly prevent the adjustment screw from easily loosening from the block.

(3) If the rotation resistance between the adjustment screw and block is reduced so much due to aged deterioration or abrasion, the fixing structure can be easily repaired by merely changing the block with new one. Herein, it is unnecessary to change the adjustment screw with new one because the adjustment screw is made by metal material having sufficient hardness and is durable for long-time use or multiple-times use.

(4) The fixing structure can be simply adjusted to provide desired rotation resistance by merely setting a hole diameter of the prepared hole of the block to an optimal value in proportion to an outer diameter (d) of the adjustment screw. Preferably, the hole diameter of the prepared hole of the block is designed within a prescribed range between 0.85d and 0.95d.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. A fixing structure of an adjustment screw for use in adjustment of closing of a tone hole of a woodwind instrument by a key system, comprising:

a screw fixing member for fixing the adjustment screw that is used for positional adjustment of a tampon closing the tone hole; and a block which is made by synthetic resin material and is attached to the screw fixing member, wherein the adjustment screw is screwed into a prepared hole of the block to be tapped by force and is further rotated to engage with a tapped hole of the screw fixing member.

2. A fixing structure of the adjustment screw according to claim 1 wherein the block is detachably attached to the screw fixing member.

3. A fixing structure of an adjustment screw for use in adjustment of closing a tone hole of a woodwind instrument by a key system, comprising:

a screw fixing member for fixing the adjustment screw that is used for positional adjustment of a tampon closing the tone hole; and a block which is made by synthetic resin material and is attached to the screw fixing member, wherein the adjustment screw is screwed into a prepared hole of the block to be tapped by force and is further rotated to engage with a tapped hole of the screw fixing member;

wherein a hole diameter of the prepared hole of the block is set in proportional to an outer diameter d of the adjustment screw within a range between 0.85d and 0.95d.

4. A fixing structure of an adjustment screw for use in adjustment of closing of a tone hole of a woodwind instrument by a key system, comprising:

a screw fixing member having a tapped hole with which the adjustment screw engages to realize positional adjustment of a tampon closing the tone hole; and a block that is made by synthetic resin material and is formed in a prescribed shape having a prepared hole penetrating therethrough, wherein the block is detachably attached to the screw fixing member so that the adjustment screw is screwed into the prepared hole of the block to be tapped by force and is further rotated to engage with the tapped hole of the screw fixing member, and wherein a hole diameter of the prepared hole of the block is set in proportion to an outer diameter d of the adjustment screw within a range between 0.85d and 0.95d.

5. A fixing structure of the adjustment screw according to claim 4 wherein the screw fixing member corresponds to a stopper that has an engagement channel engaging with the block so that a tip end of the adjustment screw engaging with the tapped hole of the stopper comes in contact with a communicating plate, and wherein both of the engagement channel and the block are formed in substantially a trapezoidal shape in cross section.

6. A fixing structure of an adjustment screw for use in adjustment of closing a tone hole of a woodwind instrument by a key system, comprising:

a screw fixing member for fixing the adjustment screw that is used for positional adjustment of a tampon closing the tone hole; and a block which is made by synthetic resin material and is attached to the screw fixing member, wherein the adjustment screw is screwed into a prepared hole of the block to be tapped by force and is further rotated to engage with a tapped hole of the screw fixing member;

wherein the block is detachably attached to the screw fixing member; and wherein a hole diameter of the prepared hole of the block is set proportion to an outer diameter d of the adjustment screw within a range 0.85d and 0.95d.

7. A fixing structure of the adjustment screw according to claim 1 wherein said block is engaged in a channel of a stopper.

8. A fixing structure of the adjustment screw according to claim 7 wherein said channel is substantially a trapezoidal shape in cross section.

* * * * *